US005454599A

United States Patent [19]

Totz et al.

[11] Patent Number: 5,454,599

[45] Date of Patent: Oct. 3, 1995

[54] SCORE CARD AND METHOD OF SCORING EVENTS THEREON

[76] Inventors: Eleanor D. Totz; Andrew B. Totz, both of #7 Oaklawn Dr., Houston, Tex. 77024

[21] Appl. No.: 293,722

[22] Filed: Aug. 22, 1994

[51] Int. Cl.[6] ..... B42D 15/00

[52] U.S. Cl. ..... 283/67; 283/48.1; 283/66.1; 283/116; 283/115; 462/64

[58] Field of Search ..... 402/79; 283/115, 283/904, 65, 67, 48.1, 49, 66.1, 116; 462/64

[56] References Cited

U.S. PATENT DOCUMENTS

| | | | |
|---|---|---|---|
| 1,464,912 | 8/1923 | Lindenschmidt | 462/64 |
| 2,666,655 | 1/1954 | Wolowitz | 283/904 X |
| 4,141,400 | 2/1979 | Mangan | 283/904 X |

*Primary Examiner*—Willmon Fridie
*Attorney, Agent, or Firm*—Michael P. Breston

[57] ABSTRACT

The score card has a front surface displaying a series of numbers arranged from a base line L into rows and columns. The numbers are derived from multiplying a known number F by a series of integers 1, 2, 3, 4 . . . N. Each number, when selected by the user, provides a running score. The score card is illustrated for use with an automatic teller machine ("ATM") which is controlled by an ATM card. The numbers on the surface of the score card are multiples of the base dollar amount dispensed by the ATM. The method of using the score card involves selecting a first score $A_1=N_1xF$ by counting $N_1$ rows from the base line L, wherein $N_1$ is a first known multiplying integer, selecting a second score $A_2=(N_1+N_2)F$ by counting $N_2$ rows from $A_1$, wherein $N_2$ is a second known multiplying integer, and finally selecting a third score $A_3=(N_1+N_2+N_3)F$ by counting $N_3$ rows from $A_2$, where $N_3$ is a third known multiplying integer, and so on.

10 Claims, 2 Drawing Sheets

SCORE CARD AND METHOD OF SCORING EVENTS THEREON

BACKGROUND OF THE INVENTION

1. Field of the Invention

This invention relates to a score card and to a method for scoring therewith events represented by multiple numeric amounts during a selected time period.

2. Copyright Notice

A portion of the disclosure of this patent document contains material which is subject to copyright protection. The copyright owner has no objection to the facsimile reproduction by any one of the patent disclosure, as it appears in the Patent and Trademark Office patent files or records, but otherwise reserves all copyright rights whatsoever.

3. Description of the Prior Art

In U.S. Pat. No. 4,689,018 is described an expense card for tracking credit card expenses. On the surface of the expense tracking card are preprinted dollar amounts, such as $10, $50, $250, $1,000, etc., in sufficient number to anticipate all the credit card expenses for about a month. The expense card user is required to check off on the expense tracking card a first dollar amount which is the same as or closest to the first credit card expense, then to check off a second dollar amount which is the same as or closest to the second credit card expense, and so on.

Whenever the sum of the credit card expenses is desired, the user must add up all the checked off dollar amounts and record, in a space provided on the card, the arrived at sum. Such a cumbersome addition, especially near the end of the month, would normally require an adding machine which may be unavailable outside of the home or office.

Therefore, the user runs the risk of incurring a credit card expense, in excess of her available credit, at the place of use, for example, at a gasoline station, at a restaurant, or other business establishment. In such event the attempted credit card charge most likely will be questioned or disapproved by the issuer of the card.

Therefore, whenever the sum of the credit card expenses is desired, the user is likely to consume substantial time in making additions. If the user fails to make them, then she will not know the total sum of her accumulated expenditures, and she will be unable to properly monitor her bank account.

The score card of this invention and the method of its use provide a simple, effective, practical and inexpensive solution to such account monitoring problems.

SUMMARY OF THE INVENTION

The preferred embodiment of this invention provides a score card for use, for example, with an automatic teller machine ("ATM"). The score card has a front surface displaying a series of multiple numbers of a known number F arranged from a base line L into rows and columns. These multiple numbers are derived from multiplying the known number F by a series of integers, such as 1, 2, 3, 4 . . . N.

The user selects a first number $A_1=N_1xF$, where $A_1$ is the first amount withdrawn from the ATM on date $D_1$, and $N_1$ is the first known multiplying integer. $A_1$ can be selected by merely counting $N_1$ rows from base line L.

Then, the user selects a second number $A_2=(N_1+N_2)F$, where $A_2$ is the last score on date $D_2$, and $N_2$ is the second known multiplying integer. $A_2$ can be selected by merely counting $N_2$ rows from $A_1$.

Then, the user selects a third number $A_3=(N_1+N_2+N_3)F$, where $A_3$ is the last score on date $D_3$, and $N_3$ is the third known multiplying integer. $A_3$ can be selected by merely counting $N_3$ rows from $A_2$, and so on until $A_n$ is selected, where $A_n$ is the last score on date $D_n$. Score $A_n$ can be selected by counting $N_n$ rows from $A_{(n-1)}$.

DETAILED DESCRIPTION OF THE INVENTION

Figure 1:
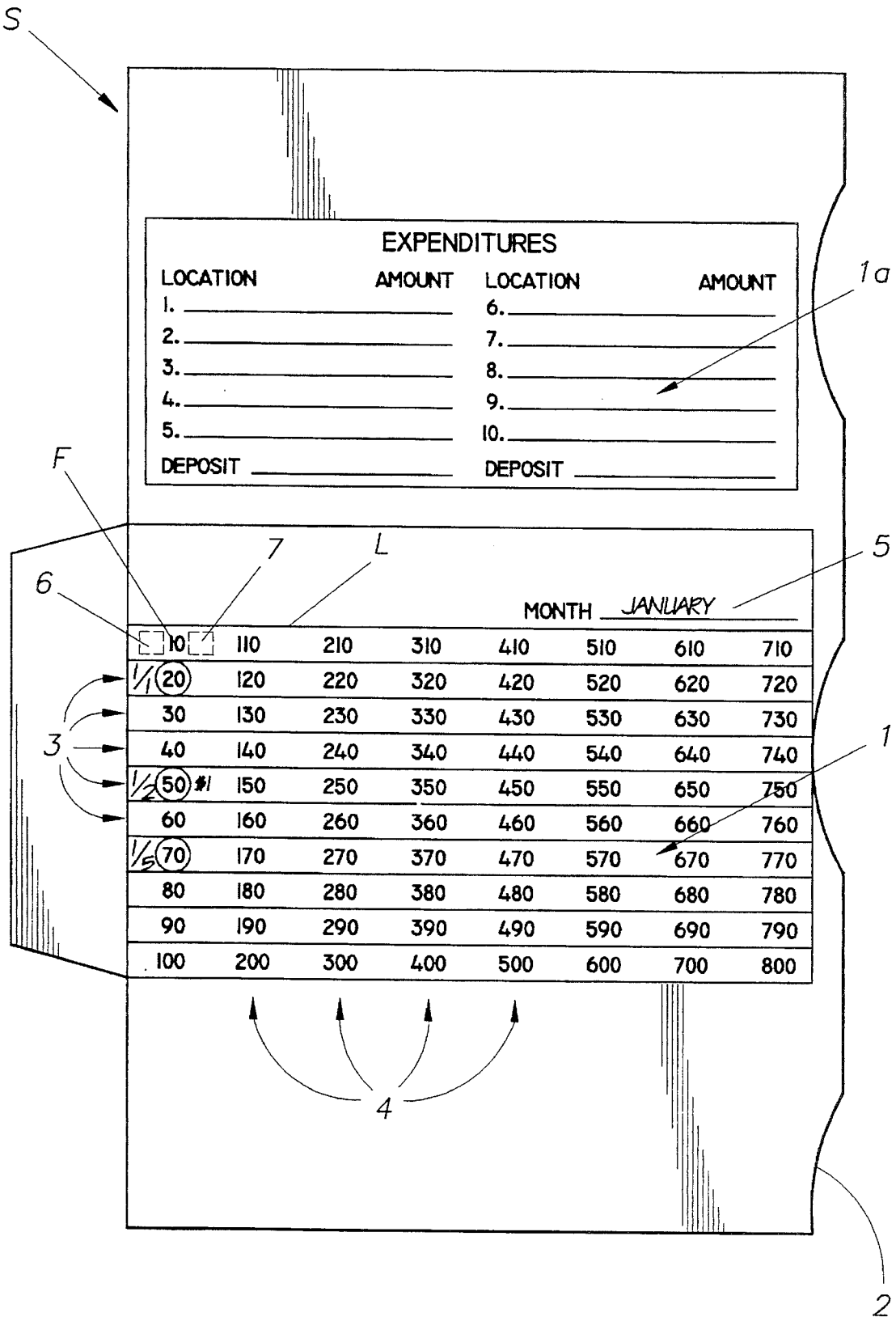
FIG. 1 illustrates the score card of this invention in its planar form so as display all the information preprinted thereon for scoring money amounts.

In accordance with a preferred embodiment of this invention, the novel score card S (FIG. 1) and the method of its use will be illustrated in conjunction with an automatic teller machine ("ATM" not shown), which is controlled and operated by an ATM card C. Score card S has the shape of an envelope (FIG. 2) for receiving therein the ATM card C.

Score card S preferably is made from a paper-type material. It has a front surface 1 having a bottom edge and a rear surface 1*a* having an opposite bottom edge. The front and rear surfaces 1, 1*a* form there between a pocket having a closed bottom end between their bottom edges and an open top end 2 between their top edges.

In use, open top end 2 allows ATM card C to slide into and out of the pocket and to become substantially fully captured therein. Score card S has outer dimensions of 2.25" by 3.5" which allow it, together with ATM card C enclosed therein, to fit within a standard sized wallet.

Front surface 1 displays a series of multiple numbers of a known base number F all arranged from a base line L into rows 3 and columns 4. The space 5 above columns 4 is for entering the selected scoring time period, for example "January". The scoring time period is assumed to be one full month which corresponds to a monthly bank statement.

Rear surface 1*a* displays useful information regarding the user's expenditures, when and where they were incurred, as well as deposits made to the user's bank account during the scoring time period.

The multiple numbers on surface 1 represent dollar amount withdrawals from the ATM and are derived from multiplying the base number F by a series of integers, such as 1, 2, 3, 4 . . . N.

The displayed numbers on front surface 1 are multiples of the particular base dollar amount dispensed by the ATM. Most ATMs dispense cash in increments of $10 and, of course, for as long as there remains a positive balance in the user's checking or savings account. A relatively few ATMs dispense cash in increments of $5 or $20.

Therefore, in the drawings the base number F=$10, and the dollar amounts on surface 1 are multiples of $10. These dollar amounts can be arranged in an ascending or descending order from base line L. Each one of columns 4 can have ten rows 3, and each one of the series of the displayed multiple numbers has a left space 6 on one side thereof and a right space 7 on the opposite side thereof for receiving scoring information. The space 6 to the left of each number is for indicating the day of the month that a cash withdrawal was made from the ATM. The space 7 to the right of each number is for indicating the service charge, if any, incurred for making the ATM transaction.

Each particular dollar amount in a column 4 can represent a running score which equals to the sum of all the dollar amounts withdrawn from the start of the scoring time period, which in the illustrated case is January 1. Such keeping up of the running score is effected by "selecting", as by a check mark next to or a circle around, a particular displayed number which represents a particular dollar amount.

More generally, the user selects on surface 1 a first score $A_1=N_1xF$, where $A_1$ is the first dollar amount withdrawn from the ATM on date $D_1$, $N_1$ is the first known multiplying integer, and F is the known base number of the ATM. $A_1$ can be selected by merely counting $N_1$ rows from base line L. Then, the user selects on surface 1*a* second score $A_2=(N_1+N_2)F$, where $A_2$ represents the total amount withdrawn from the ATM on date $D_2$, and $N_2$ is a second known multiplying integer. $A_2$ can be selected by merely counting $N_2$ rows from $A_1$. Then, the user again selects a third score $A_3=(N_1+N_2+N_3)F$, where $A_3$ represents the total amount withdrawn from the ATM on date $D_3$, and $N_3$ is a third known multiplying integer. $A_3$ can be selected by merely counting $N_3$ rows from $A_2$, and so on until $A_n$ is selected, where $A_n$ is the last score on date $D_n$, and $A_n$ represents the total amount withdrawn from the ATM on date $D_n$. $A_n$ can be selected by merely counting $N_n$ rows from $A_{(n-1)}$.

Figure 2:
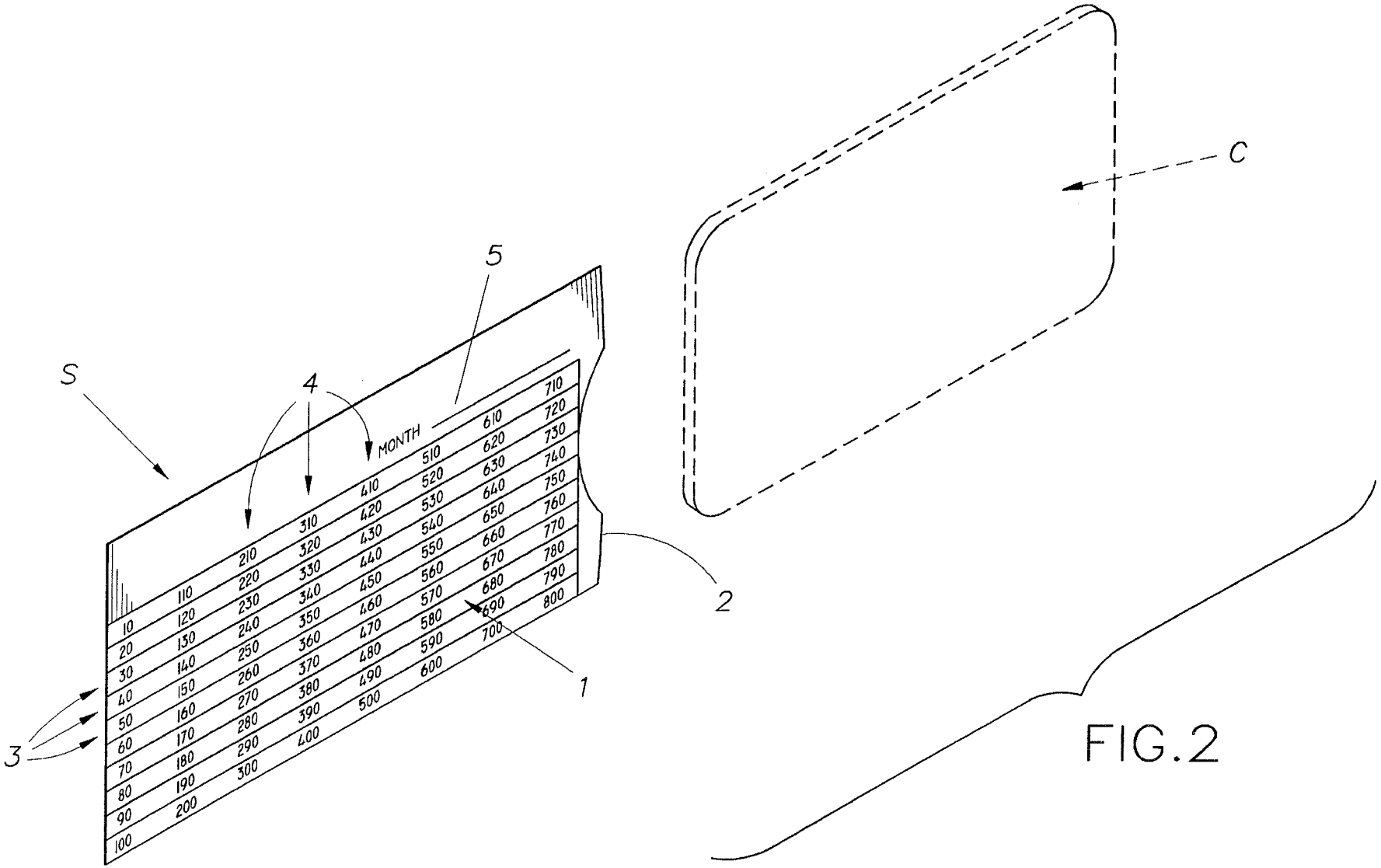
FIG. 2 is an isometric view of the score card which is shaped as an envelope to enclose therein a wallet-sized utility card used in conjunction with the score card.

The method of using score card S will be easier to understand from a numerical example with reference to FIG. 1 showing that the first $20 was withdrawn on January 1 with no service fee; $30 was withdrawn on January 2 incurring a service fee of $1; and the last $20 was withdrawn on January 5 with no service fee.

To carry out the required scoring process for this illustration, after each use of the ATM card C, the user selected a first number $A_1$=$20. Because $N_1$=2 and F=10, $20 was selected by merely counting 2 rows from base line L. Then, the user selected a second number $A_2$=50. Because $N_2$=3 and F=10, $50 was selected by merely counting 3 rows from $20. Then, the user selected a third number $A_3$=70. Because $N_3$=2 and F=10, $70 was selected by merely counting 2 rows from $50.

Hence, all that is required of the user is to count, after each money amount withdrawal, the appropriate number of rows as illustrated above. Since no arithmetical additions are required, the likelihood of the user making mistakes has been greatly reduced by this invention.

Whenever the latest score is desired, all the user needs to do is to notice on surface 1 of score card S the last selected number which represents the last score, that is, the sum of the first, second and third dollar amount withdrawals ($70=20+30+20).

Hence, following the method of this invention, before each ATM transaction is contemplated, score card S will provide to the user at a mere glance, the last score during the scoring time period, thus enabling her to monitor her bank account with greater care.

Keeping a running score in accordance with this invention consumes very little time, is convenient, and is not prone to errors.

It will be appreciated that the score card of this invention and the method of its use provide a simple, effective, practical and inexpensive solution to the known problems with the prior art.

What we claim is:

1. A method of using a score card having a front surface displaying a series of numbers derived from multiplying a known number F by a series of integers 1, 2, 3, 4 . . . N, and said multiple numbers being arranged from a base line L into rows and columns, and each displayed multiple number, when selected by the user, providing a running score of monitored events, comprising the steps of:

selecting a first score $A_1=N_1xF$ by counting $N_1$ rows from said base line L, wherein $N_1$ is a first known multiplying integer;

selecting a second score $A_2=(N_1+N_2)F$ by counting $N_2$ rows from $A_1$, wherein $N_2$ is a second known multiplying integer; and selecting a third score $A_3=(N_1+N_2+N_3)F$ by counting $N_3$ rows from $A_2$, where $N_3$ is a third known multiplying integer.

2. A method according to claim 1, wherein said numbers on said front surface represent dollar amount withdrawals from an automatic teller machine ("ATM") which is controlled by an ATM card.

3. A method according to claim 2, wherein said numbers on said front surface are multiples of a known base dollar amount dispensed by said ATM.

4. A method according to claim 3, wherein said base dollar amount dispensed by said ATM is ten Dollars, and said displayed numbers are multiples of ten Dollars,

5. A method according to claim 4, wherein each one of said columns has ten rows, and each one of said numbers has a space on either side thereof; and marking scoring information within said spaces.

6. A method for monitoring events on a score card, comprising the steps of:

displaying on said score card a series of multiple numbers derived from multiplying a known number F by a series of integers 1, 2 ,3, 4 . . . N;

arranging said numbers into rows and columns from a base line L;

selecting a first score $A_1=N_1xF$ by counting $N_1$ rows from said base line L, wherein $N_1$ is a first known multiplying integer;

selecting a second score $A_2=(N_1+N_2)F$ by counting $N_2$ rows from $A_1$, wherein $N_2$ is a second known multiplying integer; and selecting a third score $A_3=(N_1+N_2+N_3)F$ by counting $N_3$ rows from $A_2$, where $N_3$ is a third known multiplying integer, whereby said displayed multiple numbers, when selected by a user, provide a running score of said monitored events.

7. A method according to claim 6, wherein said displayed numbers on said score card represent dollar amount withdrawals from an automatic teller machine ("ATM") that is controlled by an ATM card.

8. A method according to claim 7, wherein said displayed numbers on said score card are multiples of a known base dollar amount dispensed by said ATM.

9. A method according to claim 6, wherein said displayed numbers on said score card represent dollar amounts charged by a user using a credit card.

10. A method according to claim 9, wherein said displayed numbers on said score card are multiples of a known base dollar amount.

* * * * *